US005221370A

United States Patent [19]

Jo et al.

[11] Patent Number: 5,221,370

[45] Date of Patent: Jun. 22, 1993

[54] METHOD FOR FORMING ZINC PHOSPHATE FILM ON METAL SURFACE

[75] Inventors: Masahiro Jo, Osaka; Yasutake Mino, Hyogo; Takamasa Shimizu, Nara; Koetsu Endo, Kyoto; Akio Tokuyama; Tamotsu Sobata, both of Osaka, all of Japan

[73] Assignee: Nippon Paint Co., Ltd., Osaka, Japan

[21] Appl. No.: 538,054

[22] Filed: Jun. 14, 1990

[30] Foreign Application Priority Data

Jun. 15, 1989 [JP] Japan ..... 1-153026

[51] Int. Cl.[5] ..... C23C 22/40

[52] U.S. Cl. ..... 148/250; 148/259; 148/262

[58] Field of Search ..... 148/251, 253, 254, 255, 148/258, 248, 262, 259, 250

[56] References Cited

U.S. PATENT DOCUMENTS

| | | | |
|---|---|---|---|
| 2,502,441 | 4/1950 | Dodd et al. | 148/6.15 |
| 2,854,369 | 9/1958 | Kronstein | 148/6.15 |
| 3,261,723 | 7/1966 | Craig | 148/6.15 |
| 3,769,043 | 10/1973 | Morishima et al. | 148/253 |
| 3,819,424 | 6/1974 | Russell et al. | 148/6.15 R |
| 3,945,899 | 3/1976 | Nikaido | 148/251 |
| 3,994,392 | 11/1976 | Kajiyama et al. | 148/253 |
| 4,089,708 | 5/1978 | Askienazy et al. . | |
| 4,220,485 | 9/1980 | Howell et al. | 148/255 |
| 4,264,378 | 4/1981 | Oppen et al. | 148/6.15 R |
| 4,756,772 | 7/1988 | Gazapo et al. | 148/244 |
| 4,812,175 | 3/1989 | Reghi | 148/258 |
| 4,838,957 | 6/1989 | Miyamoto et al. | 148/260 |
| 4,880,478 | 11/1989 | Emeric et al. | 148/248 |
| 5,011,551 | 4/1991 | Emeric et al. | 148/248 |

FOREIGN PATENT DOCUMENTS

| | | |
|---|---|---|
| 0321059 | 6/1989 | European Pat. Off. . |
| 2521737 | 10/1976 | Fed. Rep. of Germany . |
| 2905535 | 9/1980 | Fed. Rep. of Germany . |
| 54-24973 | 8/1979 | Japan . |
| 55-58376 | 5/1980 | Japan . |
| 58-55229 | 12/1983 | Japan . |
| 61-36588 | 8/1986 | Japan . |
| 1-162780 | 6/1989 | Japan . |
| 1-240671 | 9/1989 | Japan . |
| 1198546 | 7/1970 | United Kingdom . |
| 2041987A | 9/1980 | United Kingdom . |

OTHER PUBLICATIONS

GB Specification No. 757,050, filed Mar. 29, 1954.
Canadian Patent No. 1,133,806, filed Aug. 5, 1978.
European Patent Application No. 0,135,622, filed Aug. 22, 1983.
European Search Report.

*Primary Examiner*—Sam Silverberg
*Attorney, Agent, or Firm*—Armstrong, Westerman, Hattori, McLeland & Naughton

[57] ABSTRACT

A zinc phosphate film on a metal surface is used as a surface-protecting film and an under coating film for coating and so on. The zinc phosphate film is formed by treating a metal surface with an aqueous zinc phosphate solution. The aqueous zinc phosphate solution includes solutions containing a zinc ion in a concentration of more than 2 g/l to 20 g/l, a phosphate ion in a concentration of 5 g/l to 40 g/l, and at least one of silicotungstic acid and a silicotungstate in a concentration of 0.005 g/l to 20 g/l measured in terms of tungsten content.

5 Claims, No Drawings

METHOD FOR FORMING ZINC PHOSPHATE FILM ON METAL SURFACE

BACKGROUND OF THE INVENTION

The present invention relates to a method for forming a zinc phosphate film on a metal surface.

The zinc phosphate film on a metal surface has been used, for example, in a non-coating product as a surface-protecting film or as a lubricating film while being processed, or in a coating product as an under coating film while being coated.

Hitherto, a zinc phosphate film of this kind can be formed by chemical conversion of a metal surface with an acidic aqueous solution of zinc phosphate and thus, various kinds of methods for forming the zinc phosphate film have been proposed and actually used.

As a method for forming a zinc phosphate film in a non-coating product, there has been known a method wherein an aqueous solution of zinc phosphate added with a calcium ion is used and a fine crystalline zinc phosphate film modified with calcium is formed (Japanese Official Patent Provisional Publication, showa 55-58376). This film can be used as an auxiliary lubricating film when an iron and steel material is treated with cold working.

As a method for forming a zinc phosphate film in a coating product, there have been known methods wherein an aqueous solution of zinc phosphate added with an organic acid such as lactic acid and tartaric acid is used to form a zinc phosphate film on a galvanized steel plate surface (Japanese Official Patent Gazette, showa 54-24973), wherein an aqueous solution of zinc phosphate added with a nickel ion or a manganese ion is used to form a zinc phosphate film (Japanese Official Patent Gazette, showa 61-36588), and wherein a steel plate surface is dipped, before chemical conversion into a zinc phosphate film, in a surface-conditioning solution containing titanium phosphate colloid and then, the chemical conversion forms a fine crystalline zinc phosphate film (Japanese Official Patent Gazette, showa 58-55229).

In said hitherto-known methods, an attempt for making a zinc phosphate film of fine-grained crystals leads to elevation of film-quality, but it is not possible to increase film weight (film thickness) per unit area of the metal surface. The increase of film weight and transformation into fine-grained crystals are an anti-parallel relation.

However, to increase the film weight, particularly, in the non-coating products, it is very important to secure a necessary protecting function and a lubricating function. Needless to say, the increase of film weight should not accompany deterioration of the film quality.

SUMMARY OF THE INVENTION

In consideration of said circumstances, the subject of this invention is to provide a method for forming a zinc phosphate film of sufficient film weight with suppression of the deterioration of the film quality.

In order to solve said subject, when a metal surface is treated with an aqueous zinc phosphate solution to form a zinc phosphate film, said aqueous zinc phosphate solution in the invention is arranged so as to contain a zinc ion in a concentrain range of more than 2 g/l to 20 g/l, a phosphate ion in a concentration range of 5 g/l to 40 g/l, and silicotungstic acid and/or a silicotungstate in a concentration range of 0.005 g/l to 20 g/l on a basis being converted into the tungsten element.

In a further embodiment of the invention, the aqueous zinc phosphate solution is arranged so as to further contain at least one kind of a metal ion selected from a nickel ion, a cobalt ion, a calcium ion, a magnesium ion, and a manganese ion in a concentration range of 0.01 g/l to 20 g/l.

In another embodiment of the invention the aqueous zinc phosphate solution is arranged so as to further contain at least one kind of an acid and its salt selected from citric acid, lactic acid, tartaric acid, and glycerophosphoric acid and their salts in a concentration range of 0.1 g/l to 10 g/l.

In yet another embodiment of the invention, the aqueous zinc phosphate solution is arranged so as to further contain an accelerating agent for converting into a film.

DETAILED DESCRIPTION OF THE INVENTION

The aqueous zinc phosphate solution used in this invention is an acidic solution and, a described above, contains a zinc ion, a phosphate ion, and in addition, silicotungstic acid and/or a silicotungstate as main components.

Contents of the zinc ion are in a concentration range of more than 2 g/l to 20 g/l and, more preferably, in a range of more than 2 g/l to 10 g/l. If it is 2 g/l or less, securing sufficient film weight is difficult and, for example, in the case of a non-coating product which has this zinc phosphate film on the surface, corrosion-resistance on the surface is not possible. If it is over 20 g/l, the zinc phosphate crystals become gross, for example, in a case of a coating product that the zinc phosphate film is an under coating film, the coating film quality (corrosion-resistance of the coating film) is not good enough. Zinc ion resources include zinc oxide, zinc carbonate, and zinc nitrate and so on.

Contents of the phosphate ion are in a concentration range of 5 g/l to 40 g/l and, more preferably, in a range of 10 g/l to 30 g/l. If it is less than 5 g/l, a nonuniform film is apt to be formed and also, if it is over 40 g/l, further elevation of effects is not seen and thus, an amount for use of chemicals is large which results in an economical disadvantage. Phosphate ion resources include phosphoric acid, zinc phosphate, and manganese phosphate and so on.

Contents of the silicotungstic acid and/or silicotungstate (in a case of combined use of the acid with the salt, the total contents) are in a concentration range of 0.005 g/l to 20 g/l (on a basis of being converted into the tungsten element) and, more preferably, in a range of 0.05 g/l to 1 g/l. If it is less than 0.005 g/l, an effect to increase the film weight suppressing deterioration of the film quality can not be obtained and, if it is over 20 g/l, there may take place a problem that a film of bad quality such as a nonuniform film or a film of an amorphous type is only obtained and an amount for use of chemicals becomes large which results in an economical disadvantage. Silicotungstates include, for example, an alkali metal salt of silicotungstic acid, an alkaline earth metal salt of silicotungstic acid and an ammonium salt of silicotungstic acid and so on.

The aqueous zinc phosphate solution usually contains, in addition to the forementioned and as an accelerating agent for converting into a film, at lease one kind selected from a nitrite ion, m-nitrobenzenesulfonate ion, hydrogen peroxide, a nitrate ion, and a chlorate ion. Contents of the nitrite ion are in a concentration range of 0.01 g/l to 0.5 g/l and, more preferably, in a range of 0.01 g/l to 0.4 g/l. Contents of the m-nitrobenzenesulfonate ion are in a concentration range of 0.05 g/l to 5 g/l and, more preferably, in a range of from 0.1 g/l to 4 g/l. Contents of the hydrogen peroxide (converted into 100% $H_2O_2$) are in a concentration range of 0.5 g/l to 10 g/l and, more preferably, in a range of 1 g/l to 8 g/l. Contents of the nitrate ion are in a concentration range of 1 g/l to 60 g/l. Contents of the chlorate ion are in a concentration range of 0.05 g/l to 2 g/l. If the contents of each accelerating agent for converting into a film are less than said indicated amounts, it is difficult to obtain a film of sufficient quality and, for example, occurrence of yellow rust may be observed in a case where a film is formed on an iron-based surface. If the contents of an accelerating agent for converting into a film are over said indicated amounts, a nonuniform film is apt to be formed and an economical disadvantage takes place. Nitrite ion resources included sodium nitrite and ammonium nitrite and so on. M-nitrobenzenesulfonate ion resources include sodium m-nitrobenzenesulfonate and so on. Hydrogen peroxide resources include aqueous hydrogen peroxide and so on. Nitrate ion resources include nitric acid, sodium nitrate, and ammonium nitrate and so on. Chlorate ion resources include sodium chlorate and ammonium chlorate and so on.

Furthermore, the aqueous zinc phosphate solution may contain, in addition to the forementioned, a metal ion, an organic acid, and an organic acid salt as described below.

Regarding the metal ion, at least one kind selected from a nickel ion, a cobalt ion, a calcium ion, a magnesium ion, and a manganese ion is contained and the total contents are in a concentration range of 0.01 g/l to 20 g/l and, more preferably, in a range of 0.5 g/l to 10 g/l. If it is less than 0.01 g/l, an effect upon making a zinc phosphate film of fine-grained crystals, that is an addition effect of a metal ion, does not appear. If it is over 20 g/l, the securing of a sufficient film weight is disturbed and the corrosion-resistance is bad in a case where a film for a non-coating product is prepared. Besides, each metal ion is preferred to be in the contents in the undermentioned range.

Nickel ion: from 0.1 g/l to 6 g/l
Cobalt ion: from 0.1 g/l to 6 g/l
Calcium ion: from 0.5 g/l to 10 g/l
Magnesium ion: from 0.5 g/l to 10 g/l
Manganese ion: from 0.1 g/l to 3 g/l.

Resources for each metal ion include the undermentioned. For the nickel ion are exemplified nickel carbonate, nickel nitrate, nickel chloride, and nickel phosphate and so on; for the cobalt ion are exemplified cobalt carbonate, cobalt nitrate, and cobalt chloride and so on; for the calcium ion are exemplified calcium carbonate, calcium chloride, and calcium phosphate and so on; for the magnesium ion are exemplified basic magnesium carbonate, magnesium nitrate, magnesium chloride, and magnesium phosphate and so on; for the manganese ion are exemplified manganese carbonate, manganese nitrate, manganese chloride, and manganese phosphate and so on.

Furthermore, together with said metal ion, a fluoride ion may be added in a concentration range of 0.05 g/l to 4 g/l and, more preferably, in a range of 0.1 g/l to 2 g/l. When the fluoride ion is contained, the treating temperature for an aqueous zinc phosphate solution may be lowered. As resources for the fluoride ion are cited hydrofluoric acid, borofluoric acid, hydrosilicofluoric acid, and their salts as well.

Regarding the organic acid or the organic acid salt, citric acid, lactic acid, tartaric acid, glycerophosphoric acid, and their salts as well (for example, sodium glycerophosphate) are cited, at least one kind among these compounds is contained, and the contents (a total amount in a combined use of plural compounds) is in a concentration range of 0.1 g/l to 10 g/l and, more preferably, in a range of 0.1 g/l to 5 g/l. When the organic acid or organic acid salt is contained, the effect of this invention, which means increase of the film weight with suppressing deterioration of the film, is more enhanced. If it is less than 0.1 g/l, a sufficient addition effect is not obtained and, if it is over 10 g/l, the film weight inversely decreases.

The aqueous zinc phosphate solution used in this invention, in general, is simply obtainable with a concentrated, undiluted solution containing more than the indicated contents of each component being beforehand prepared and dilution of this solution with water is carried out to adjust the component at the indicated contents.

For the concentrated, undiluted solution, there are one-solution type and two-solution type and, practically, the undermentioned type are cited.

(1) A concentrated undiluted solution of the one-solution type which is obtained by mixing so that, when the zinc ion resources and phosphate ion resources are converted into weight of ionic forms and the silicotungstic acid and/or silicotungstate are converted into weight of the tungsten element (W), the ratios among these are 1:(from 2.5 to 400):(from 0.005 to 200) for the zinc ion:the phosphate ion:the silicotungstic acid and/or silicotungstate (as W).

(2) Furthermore, a concentrated undiluted solution of the one-solution type described in said (1) which contains an accelerating agent for converting into a film (a), whose coexistence in a condition of the undiluted solution shows no trouble.

As an accelerating agent for converting into a film (a) are cited the nitrate ion resources (nitric acid, sodium nitrate, and ammonium nitrate) and the chlorate ion resources (sodium chlorate and ammonium chlorate) and so on.

The concentrated undiluted solution of the one-solution type may further contain a suitable compound selected from metal ion resources above mentioned in detail, the fluoride ion resources, an organic acid, and an organic acid salt and so on.

(3) A concentrated undiluted solution of the two-solution type which is composed of A and B solutions, the former solution of which contains at least the zinc ion resources and phosphate ion resources, and the latter of which contains an accelerating agent for converting into a film (b), and the silicotungstic acid and/or silicotungstate are contained in at least one of the A and B solutions, and the undiluted solution is used in the manner that, when the zinc ion resources and the phosphate ion resources are converted into ionic forms and the silicotungstic acid and/or the silicotungstate into the tungsten element (W), the weight ratios among these are 1 vs. (from 2.5 to 400) vs. (from 0.005 to 200) for the zinc ion, the phosphate ion, and the silicotungstic acid and/or silicotungstate (as W), respectively.

As the accelerating agent for converting into a film (b) are cited a compound, whose coexistence in a condition of the undiluted solution causes trouble, such as the nitrite ion resources (nitric acid, sodium nitrite, and amonium nitrite), m-nitrobenzenesulfonate ion resources (sodium m-nitrobenzenesulfonate), and hydrogene peroxide resources (aqueous hydrogen peroxide) and so on.

Said concentrated undiluted solution usually contains each component in the manner that the A solution is used with 10–100 times dilution (weight ratio) and the B solution with 100–10,000 times dilution (weight ratio).

In case of the solution of the two-solution type being composed of said A solution and B solution, compounds whose coexistence is a condition of the undiluted solution causes trouble may be arranged separately.

In case of the solution of the two-solution type, the undermentioned compounds are contained in the A solution.

The zinc ion resources (zinc oxide, zinc carbonate, and zinc nitrate), phosphate ion resources (phosphoric acid, zinc phosphate, and manganese phosphate), nitrate ion resources (nitric acid, sodium nitrate, and ammonium nitrate), metal ion resources (nickel carbonate, nickel nitrate, nickel chloride, nickel phosphate, cobalt carbonate, cobalt nitrate, cobalt chloride, calcium carbonate, calcium chloride, calcium phosphate, basic magnesium carbonate, magnesium nitrate, magnesium chloride, magnesium phosphate, manganese carbonate, manganese nitrate, manganese chloride, and manganese phosphate), fluoride ion resources (hydrofluoric acid, borofluoric acid, hydrosilicofluoric acid, and salts of these acids), organic acids (citric acid, lactic acid, tartaric acid, and glycerophosphoric acid), and a salt of each of these organic acids.

The undermentioned compounds may be contained in either the A or B solution.

Silicotungstic acid, silicotungstate (alkali metal salts of silicotungstic acid, alkaline earth metal salts of silicotungstic acid, and an ammonium salt of silicotungstic acid), and chlorate ion resources (sodium chlorate and ammonium chlorate).

The following compounds are contained in the B solution.

The nitrite ion resources (sodium nitrite and ammonium nitrite), m-nitrobenzenesulfonate ion resources (sodium m-nitrobenzenesulfonate), and hydrogen peroxide resources (aqueous hydrogen peroxide).

Besides, in a case where the A solution contains the manganese ion resources, the chlorate ion resources are preferred to be contained in the B solution.

In this invention, using said aqueous zinc phosphate solution, for example, a zinc phosphate film is formed on a metal surface as mentioned below.

At first, a metal surface for forming a film is degreased. This degreasing treatment is carried out by using an alkaline degreasing agent which is sprayed and/or in which dipping is carried out at 20°–60° C. for 2 minutes. After the degreasing is carried out, rinsing treatment with tap water is carried out and, to make a zinc phosphate film of more miniaturized crystals, a surface-conditioning treatment is favorably carried out. This treatment is carried out by a surface-conditioning agent being sprayed and/or by being dipped in the agent. Then, spraying and/or dipping treatment with an aqueous zinc phosphate solution are carried out at 20°–70° C. (preferably, 35°–60° C.), rinsing with tap water followed by that with deionized water is carried out, and finally draining followed by drying is carried out.

As a metal material to form a zinc phosphate film are cited, for example, a material having an iron-based surface, a zinc-based surface, a zinc alloy-based surface, an iron-zinc alloy-based surface, or a zinc-nickel alloy-based surface, and furthermore, a material having a plural kinds of metal-based surfaces, for example, such one having an iron-based surface in one side and a zinc alloy-based surface in the other side.

A metal material having on the surface a zinc phosphate film, which is formed by a method in the present invention, may be used as a material for a coating product which is further piled on the zinc phosphate film by a coating film to make a layer, and as a material for a non-coating product which is used without the further piling of a coating film (for example, so-called material for a drum can).

Besides, needless to say, compounds and treatment used in this invention are not limited within said forementioned examples.

Next, practical examples and examples for comparison are explained.

EXAMPLES 1 TO 6 AND EXAMPLES FOR COMPARISON 1 TO 3

The processes and conditions for forming films are as the undermentioned. Degreasing→rinsing with water →surface conditioning→conversion treatment with an aqueous zinc phosphate solution (film formation)→rinsing with water (tap water)→rinsing with water (deionized water)→draining and drying.

Degreasing: Using a degreasing agent of medium alkalinity (Surfcleaner S 102, made by Nippon Paint Co., Ltd.), by which an aqueous 2% by weight solution is prepared and the degreasing is carried out by spraying at 50° C. with a pressure of 1.0 kg/cm$^2$ for 90 seconds.

Surface-conditioning: An aqueous 0.1% by weight solution of a fine-powdered surface-conditioning agent (Surffine 5N-5, made by Nippon Paint Co., Ltd.), in which titanium phosphate is a main component, is sprayed at a pressure of 1.0 kg/cm$^2$ for 15 seconds to condition the surface.

Conversion treatment with aqueous zinc phosphate solution: It is carried out by spraying an aqueous zinc phosphate solution having the composition as shown in Table 1 at 50° C. with a pressure of 1.0 kg/cm$^2$ for 90 seconds.

Rinsing: It is carried out by spraying tap water (or deionized water) at a pressure of 1.0 kg/cm$^2$ for 15 seconds.

Drying: It is carried out with hot air at 80° C.

Besides, in the Tables 1, 3, and 5, the total acidity, free acidity, * 1, * 2, * 3, and * 4 are described as follows.

The total acidity was determined whereby 10 ml of an aqueous zinc phosphate solution was taken and titrated with a 0.1N sodium hydroxide solution. The indicator used was P. P (phenolphthalein).

The free acidity was determined whereby 10 ml of an aqueous zinc phosphate solution was taken and titrated with a 0.1N sodium hydroxide solution. The indicator used was B. P. B (bromophenolblue).

* 1 . . . silicotungstic acid
* 2 . . . sodium silicotungstate
* 3 . . . sodium tungstate
* 4 . . . phosphotungstic acid.

All the chemicals, * 1 to * 4, are made by Nippon Muki Kagaku Kogyo Co., Ltd.

As the metal material were used the undermentioned two kinds in all the examples. Metal material ① JIS G3131 (hot rolled steel plate) SPHC.

Metal material ② JIS G3141 (cold rolled steel plate) SPCC.

The zinc phosphate films in the examples 1 to 6 and the examples for comparison 1 to 3 were subjected to film-weighing and tests for corrosion-resistance (dipping test in deionized water and test for wetting-resistance). Results are shown in Table 2.

CONDITIONS FOR TESTING WITH DEIONIZED WATER

After being subjected to dipping of a contacting area of 105 $cm^2$ for a period of 24 hours at 20° C., the generated number of rust points was determined.

TEST CONDITIONS FOR WETTING-RESISTANCE

Several pieces of slices for examination were allowed to stand for 24 hours under surroundings of 80% relative humidity which was adjusted at 40° C. with an oversaturated solution of sodium sulfate and rusting appearance is examined.

Evaluation standards: double circles . . . no change; single circle . . . from 1 to 5% rusting; black circle . . . from 5 to 10% rusting; triangle . . . from 10 to 50% rusting; cross . . . 50% or more rusting.

Degreasing: Using a degreasing agent of medium alkalinity (Surfcleaner SE105, made by Nippon Paint Co., Ltd.), the degreasing was carried out whereby an aqueous 1.5% by weight solution of the agent was prepared and sprayed at 40° C. with a pressure of 1.0 $kg/cm^2$ for 120 seconds. Composition of the aqueous zinc phosphate solutions are as shown in Table 3.

Film formation: It was carried out by spraying at the undermentioned temperature with a pressure of 1.0 $kg/cm^2$ for 120 seconds.

Example ⑦: temperature of 80° C.

Example ⑧: temperature of 45° C.

Example for comparison ④: temperature of 45° C.

The film weight and corrosion-resistance of zinc phosphate films themselves were determined as carried out in the example 1, and a coating film being piled on the zinc phosphate film surface, making a layer, was formed with spray coating of an acryl paint (Superlack E-41) diluted with a solvent, and its corrosion-resistance was examined. Besides, the film thickness of dried coating films was about 40 μm. Results are shown in Table 4.

Besides the corrosion-resistance of coating films was evaluated as follows. A X-shaped cut (cross cut) was made in a coating film and subjected to a brine-spraying test (for a test period of 240 hours) according to a procedure in the JIS-2371-1955, and the cross cut part was peeled off with a tape and the peeled off width of coating (one side) was measured. As the peeling-off is smaller, the corrosion-resistance is more superior.

TABLE 1

| | $Zn^{2+}$ (g/l) | $PO_4^{3-}$ (g/l) | tungsten resources (g/l) #1 | | $Ni^{2+}$ (g/l) | $NO_2^-$ (g/l) | $NO_3^-$ (g/l) | total acidity point | free acidity point |
|---|---|---|---|---|---|---|---|---|---|
| example 1 | 2.2 | 8.5 | 0.05 | *1 | — | 0.075 | 13.5 | 13.5 | 0.9 |
| example 2 | 2.6 | 8.6 | 0.1 | *1 | 0.42 | 0.075 | 12.7 | 14.4 | 1.3 |
| example 3 | 2.2 | 8.5 | 10.0 | *1 | — | 0.15 | 13.5 | 13.7 | 0.9 |
| example 4 | 2.0 | 8.5 | 0.05 | *1 | — | 0.075 | 47.2 | 15.0 | 1.3 |
| example 5 | 3.0 | 35 | 0.05 | *1 | — | 0.15 | 13.5 | 18.5 | 1.5 |
| example 6 | 2.2 | 8.5 | 0.05 | *2 | — | 0.075 | 13.5 | 13.3 | 0.8 |
| example for comparison 1 | 2.2 | 8.5 | — | | — | 0.075 | 13.5 | 13.6 | 0.9 |
| example for comparison 2 | 2.6 | 8.6 | 0.1 | *3 | 0.42 | 0.075 | 12.7 | 14.3 | 1.3 |
| example for comparison 3 | 2.6 | 8.6 | 1.0 | *4 | 0.42 | 0.075 | 12.7 | 14.4 | 1.3 |

#1 converted into the tungsten element

TABLE 2

| | film weight ($g/m^2$) | | dipping test in deionized water | | test for wetting-resistance | |
|---|---|---|---|---|---|---|
| | SPCC | SPHC | SPCC | SPHC | SPCC | SPHC |
| example 1 | 3.2 | 3.8 | ⊙ | ⊙ | ○ | ○ |
| example 2 | 3.0 | 3.6 | ⊙ | ⊙ | ⊙ | ⊙ |
| example 3 | 2.7 | 3.0 | ○ | ⊙ | ○ | ○ |
| example 4 | 3.4 | 4.0 | ⊙ | ⊙ | ○ | ○ |
| example 5 | 3.5 | 4.0 | ⊙ | ⊙ | ○ | ○ |
| example 6 | 3.3 | 3.9 | ⊙ | ⊙ | ○ | ○ |
| example for comparison 1 | 2.5 | 3.0 | ○ | ⊙ | Δ | ○ |
| example for comparison 2 | 1.9 | 2.7 | Δ | ○ | ○ | ⊙ |
| example for comparison 3 | 2.0 | 2.8 | Δ | ○ | ○ | ⊙ |

EXAMPLES 7 AND 8 AND EXAMPLE FOR COMPARISON 4

The processes and conditions for film formation are as carried out in the example 1 except the following points.

TABLE 3

| | $Zn^{2+}$ (g/l) | $PO_4^{3-}$ (g/l) | tungsten compound (g/l) #1 | | $Ca^{2+}$ (g/l) | $NO_2^-$ (g/l) | $NO_3^-$ (g/l) | sodium glycero-phosphate (g/l) | total acidity point | free acidity point |
|---|---|---|---|---|---|---|---|---|---|---|
| example 7 | 2.6 | 5.5 | 0.05 | *1 | 5.8 | — | 40.0 | — | 14.5 | 1.0 |
| example 8 | 5.4 | 14.0 | 0.05 | *1 | — | 0.06 | 4.4 | 1.5 | 21.0 | 0.2 |
| example for comparison 4 | 5.4 | 14.0 | — | | — | 0.06 | 4.4 | 1.5 | 21.0 | 0.2 |

#1 converted into the tungsten element

TABLE 4

| | zinc phosphate film | | corrosion-resistance of coating film |
|---|---|---|---|
| | film weight ($g/m^2$) | wetting-resistance | |
| example 7 | 3.0 | ◎ | not abnormal |
| example 8 | 2.8 | ◎ | 2–3 mm |
| example for comparison 4 | 2.0 | ○ | 5–6 mm |

TABLE 6

| | film weight ($g/m^2$) | corrosion-resistance of zinc phosphate film | amount of refuse in cold heading |
|---|---|---|---|
| example 9 | 8.0 | | little |
| example for comparison 5 | 6.0 | Δ | little |
| example for comparison 6 | 7.5 | Δ | much |

EXAMPLE 9 AND EXAMPLES FOR COMPARISON 5 AND 6

The processes and conditions for forming a film are as follows.

Pickling with hydrochloric acid→rinsing with water→treatment for removing smut→rinsing with water→formation of film by treating with aqueous zinc phosphate solution (film conversion treatment)→rinsing with water→lubricating→drying→cold drawing process→cold heading process.

Pickling with hydochloric acid: Using a 10% aqueous solution of hydrochloric acid, dipping at room temperature for 30 minutes is carried out.

Treatment for removing smut: Using an aqueous solution which contains 3% of sodium hydroxide and 3% of potassium permanganate, dipping is carried out at temperature of 50° to 60° C. for 5 minutes.

Formation of film by treating with the zinc phosphate solution: In the aqueous zinc phosphate solutions having the composition as shown in Table 5, dipping is carried out at 70° C. for 5 minutes.

Lubricating: Using an aqueous solution which contains 5% of quick lime and 2% of lead laurate, dipping is carried out at 60° C. for 5 minutes.

Drying: It is carried out with heated air under a temperature of 80° C.

Metal materials are the bearing steel wires (SUJ-2).

Besides, a reduction of area in the cold drawing process is about 10%.

The corrosion-resistance of a zinc phosphate film (a film after the lubricating treatment) on a bearing steel wire was examined as carried out in the example 1 and also, the amount of refuse in cold heading (fragments of the zinc phosphate film and the lubricating agent) made during the heading process was examined. If the amount is large, inferior processing and damage of a processing instrument may take place. Results are shown in Table 6.

As seen in Tables 2, 4, and 6, in a case of the examples which contains a compound in a silicotungstic acid series in an aqueous zinc phosphate solution, sufficient film weight is obtained compared with that in the examples for comparison and, it is recognized that not only the corrosion-resistance of zinc phosphate films themselves but also that of coating films formed on the zinc phosphate films are greatly improved when compared with those in the examples for comparison.

From comparison of the example 2 with the examples for comparison 2 and 3, it is well understood that only a compound is a silicotungstic acid series among tungsten compounds displays sufficient effects.

In the method of this invention, since an aqueous zinc phosphate solution having said composition is used, it is possible to form a zinc phosphate film of sufficient film weight on a metal surface, with supressing deterioration of film quality.

What is claimed is:

1. A method for forming a zinc phosphate film on a metal surface, comprising treatment of said metal surface with an aqueous zinc phosphate solution, said zinc phosphate solution containing a zinc ion in a concentration of more than 2 g/l to 20 g/l, a phosphate ion in a concentration of 5 g/l to 40 g/l, and at least one of silicotungstic acid and a silicotungstate in a concentration of 0.005 g/l to 20 g/l measured in terms of tungsten content.

2. A method for forming a zinc phosphate film on a metal surface as claimed in claim 1, wherein the aqueous zinc phosphate solution contains at least one metal ion selected from the group consisting of a nickel ion, a cobalt ion, a calcium ion, a magnesium ion, and a manganese ion, in a concentration of 0.01 g/l to 20 g/l.

3. A method for forming a zinc phosphate film on a metal surface as claimed in claim 1 or 2, wherein the aqueous zinc phosphate solution contains an accelerating agent.

TABLE 5

| | $Zn^{2+}$ (g/l) | $PO_4^{3-}$ (g/l) | tungsten resources (g/l) #1 | | $Ni^{2+}$ (g/l) | $NO_2^-$ (g/l) | $NO_3^-$ (g/l) | total acidity point | free acidity point |
|---|---|---|---|---|---|---|---|---|---|
| example 9 | 5.0 | 14.0 | 0.2 | *1 | 0.02 | 0.15 | 12.0 | 27.0 | 4.5 |
| example for comparison 5 | 5.0 | 14.0 | — | | 0.02 | 0.15 | 12.0 | 27.0 | 4.5 |
| example for comparison 6 | 5.0 | 14.0 | — | | 0.02 | 0.15 | 12.0 | 27.0 | 4.5 |

#1 converted into the tungsten element

4. A method for forming a zinc phosphate film on a metal surface as claimed in claim 1 or 2, wherein the aqueous zinc phosphate solution contains at least one compound selected from the group consisting of citric acid, lactic acid, tartaric acid, glycerophosphoric acid, and salts thereof, in a concentration of 0.1 g/l to 10 g/l.

5. A method for forming a zinc phosphate film on a metal surface as claimed in claim 4, wherein the aqueous zinc phosphate solution contains an accelerating agent.

* * * * *